US010184650B1

(12) United States Patent
Tanzini et al.

(10) Patent No.: US 10,184,650 B1
(45) Date of Patent: Jan. 22, 2019

(54) DIVERSIONARY LIGHT END CAP

(71) Applicant: Peacekeeper Products International LLC, Pomona, CA (US)

(72) Inventors: Philip J. Tanzini, Chino Hills, CA (US); Nicolas J. Tanzini, Chino Hills, CA (US)

(73) Assignee: PEACEKEEPER PRODUCTS INTERNATIONAL LLC, Pomona, CA (US)

( * ) Notice: Subject to any disclaimer, the term of this patent is extended or adjusted under 35 U.S.C. 154(b) by 75 days.

(21) Appl. No.: 15/266,909

(22) Filed: Sep. 15, 2016

(51) Int. Cl.

| | |
|---|---|
| ***F21V 33/00*** | (2006.01) |
| ***F21V 23/04*** | (2006.01) |
| ***F21L 4/00*** | (2006.01) |
| ***F21V 3/04*** | (2018.01) |
| ***F21V 17/12*** | (2006.01) |
| ***F21V 23/00*** | (2015.01) |
| ***F21V 23/06*** | (2006.01) |
| ***F41B 15/02*** | (2006.01) |
| *F21Y 115/10* | (2016.01) |

(52) U.S. Cl.
CPC ..... *F21V 23/0407* (2013.01); *F21L 4/005* (2013.01); *F21V 3/04* (2013.01); *F21V 17/12* (2013.01); *F21V 23/007* (2013.01); *F21V 23/0428* (2013.01); *F21V 23/06* (2013.01); *F41B 15/022* (2013.01); *F21Y 2115/10* (2016.08)

(58) Field of Classification Search
CPC ..... F21V 23/0407; F21V 23/06; F21V 3/04; F21V 17/12; F21L 23/0428; F21L 4/005; F21Y 2115/10
See application file for complete search history.

(56) References Cited

U.S. PATENT DOCUMENTS

| | | | | |
|---|---|---|---|---|
| 5,287,255 | A | 2/1994 | Strodtman | |
| 5,372,363 | A | 12/1994 | Siddle | |
| 5,568,922 | A | 10/1996 | Siddle | |
| 5,647,591 | A * | 7/1997 | Parsons | F21L 4/00 362/102 |
| 5,690,552 | A | 11/1997 | Siddle | |
| 5,868,621 | A | 2/1999 | Parsons | |
| 6,056,643 | A | 5/2000 | Wilmoth, III | |
| 6,283,609 | B1 * | 9/2001 | Parsons | F21L 15/06 362/187 |
| 6,386,726 | B1 | 5/2002 | Macierowski et al. | |
| 7,223,175 | B2 | 5/2007 | Otto | |
| 8,568,242 | B2 | 10/2013 | Milligan | |

(Continued)

*Primary Examiner* — Ali Alavi
(74) *Attorney, Agent, or Firm* — Womble Bond Dickinson (US) LLP

(57) ABSTRACT

An end cap accessory for use with a baton. The end cap accessory includes an attachment section that removably attaches to an end of a handle section of a baton. The end cap further includes a tubular section with an opening that faces away from the attachment section, wherein the tubular section includes therein a battery compartment for holding a battery, a light source operable to emit a light when powered by the battery, and a lens operable to focus the light emitted by the light source towards the opening. In addition, the end cap includes a push button positioned on an exterior surface of the tubular section, wherein the push button is operable to activate the light source to emit light when held in a depressed position.

21 Claims, 3 Drawing Sheets

(56) References Cited

U.S. PATENT DOCUMENTS

| | | | | |
|---|---|---|---|---|
| 8,747,233 | B1 | 6/2014 | Klein | |
| 8,794,782 | B2 * | 8/2014 | Bushee | F21V 33/0076 362/102 |
| 9,207,040 | B2 | 12/2015 | Bushee et al. | |
| 2002/0162852 | A1 * | 11/2002 | Cellini | F41B 15/02 222/1 |
| 2005/0279769 | A1 * | 12/2005 | Cellini | F41B 15/02 222/192 |
| 2007/0019398 | A1 * | 1/2007 | Chen | B60Q 7/00 362/102 |
| 2008/0225519 | A1 * | 9/2008 | Uke | F21L 4/005 362/202 |
| 2010/0061118 | A1 * | 3/2010 | Liu | F21V 5/04 362/617 |
| 2013/0050993 | A1 * | 2/2013 | Campman | F21L 4/005 362/102 |

* cited by examiner

DIVERSIONARY LIGHT END CAP

FIELD

An embodiment is related to an end cap accessory that removably attaches to a baton, and more specifically to an end cap accessory that provides a diversionary light. Other embodiments are also described.

BACKGROUND

For many years, the law enforcement industry has utilized a variety of less than lethal weapons. The need to stop a violent threat without the necessity of fatally injuring a suspect with a firearm is always desirable.

Police batons have been an effective less lethal option that has been used in the law enforcement industry for many decades. Police batons are typically part of an officer's duty belt which carries a wide variety of duty gear including, but not limited to a hand gun, ammo clips, hand cuffs, police radios, flashlights, pepper spray, Tasers®, etc.

With the evolution of the lighting industry in the past decade, many companies have developed smaller plastic flashlights to gain space and/or reduce weight on an officer's duty belt. Other companies have attempted to inherently combine flashlights with firearms, Tasers®, and more typically, batons or other impact weapon systems. Unfortunately, in the process, either the effectiveness of the impact weapon, or the flashlight, gets compromised in the process. In particular, incorporating a flashlight into an impact weapon has brought on a new set of challenges to flashlights. These challenges include the usability and durability to any flashlight system.

Representatively, when a typical flashlight is incorporated into an impact weapon, flashlights don't have the necessary durability to continue to function as a standalone flashlight, and have a tendency to break or fail. This is because the use of an impact weapon generates "impact" which places unusual wear on a flashlight with a glass or crystal bulb or lens.

In addition, flashlights with a typical wafer type, or even a single "AA" type, battery can have limitations with respect to their illumination capability and duration of use.

Also, flashlights with a typical constant "on" or "off" switch typically drain a battery more quickly. Though some baton manufacturers have added flashlights to their batons, the attempt to use a flashlight with a wafer or single "AA" type battery as a distracting or diversionary light only compromises the flashlight's power and ability to be bright enough to be an effective diversionary light source. This can further compromise officer safety when a flashlight is used for general illumination purposes and as a potential diversionary device alike, because of the accelerated drop in illumination from an insufficient battery source. Therefore, a lighting system that is used as a diversionary device requires sufficient brightness to be effective but will not have the sustainability to operate as an effective flashlight. Conversely, a flashlight that requires a lower lumen output to be an effective, durable, and sustainable illuminating tool cannot have the ability or lumen rating to be an effective diversionary device, and may compromise officer safety.

Furthermore, the use of positional constant "on" or "off" switches that are incorporated into flashlights on impact weapons require the officer, under the immediate physical stress of a situation, to have one more item to consider along with all other elements of a heightened scenario.

SUMMARY

The instant invention is directed to an illuminating baton accessory that can be added to a baton. In particular, the illuminating device can be an end cap accessory that is added to the handle of an expandable impact weapon. The illuminating device may be capable of emitting a focused light of an intensity sufficient to distract, interfere with, or otherwise impair, a subject's vision to the extent that the subject is diverted or distracted from carrying out an action. In addition, the device may have the unique ability to house two "AA" batteries in a side by side configuration. Still further, the illuminating device may have a bilateral switch which in turn would allow an officer to distract a subject at-will. In particular, the bilateral configuration will minimize the necessity to seek a positional "on/off" switch under stress and improve officer safety. In addition, the illuminating diversionary device accessory may have a focused polycarbonate or acrylic lens, which adds further durability.

More specifically, the illuminating device may be an illuminating diversionary end cap designed to emit a focused or collimated light in regular or intermittent flashes. In other words, the end cap may emit a strobe light. Alternatively, the illuminating device may emit a focused or collimated light in a solid, single or otherwise constant stream. In this aspect, the expandable baton can be used as a combined close quarters non-lethal system rather than solely an effective impact weapon.

The illuminating diversionary end cap can also be used as a diversionary device prior to, and in conjunction with, other close quarters non-lethal options (OC, Taser®, etc.), or other joint officer tactics, etc. This system can create a tactical advantage both in the field and within a correctional environment (cell extractions). This system can also be used to aid in escalating or de-escalating to/from other non-lethal technologies in either environment.

In this aspect, the illuminating diversionary end cap endures the toughest of environments including its own inherent application attached to an impact weapon. In addition, bilateral on/off textured buttons on either side of the handle body allows the illuminating diversionary end cap to be easily accessed under stress, during a quick tactical draw, with or without tactical gloves. Furthermore, the illuminating diversionary end cap provides the highest lumen rating possible for its size and capable use on an expandable baton without compromising the effectiveness of the impact weapon.

More specifically, in one embodiment, the end cap accessory includes an attachment section that removably attaches to an end of a handle section of a baton. The end cap accessory further includes a tubular section with an opening that faces away from the attachment section, wherein the tubular section includes therein a battery compartment for holding a dual side-by-side battery configuration, a light source operable to emit a solid or strobed light when powered by the battery, and a lens operable to focus the light emitted by the light source towards the opening. In addition, the end cap accessory may include a push button positioned on an exterior surface of the tubular section, wherein the push button is operable to activate the light source to emit a solid or strobed light when held in a depressed position. An end section may further be attached to the tubular section. The end section may have a crenelated bezel that is positioned around the opening of the tubular section. In one embodiment, the light source is a light source that emits at least 750 lumens of light when powered by a power source, for example, a dual set of batteries. The light source may, for example, be a light-emitting diode (LED). The lens may be a collimated acrylic lens or a collimated polycarbonate lens. In some embodiments, the exterior surface of the tubular section is knurled. In addition, the push button may have a textured surface and a surface surrounding the push button may be smooth. In some embodiments, the attachment section and the tubular section are formed of aluminum material. In one embodiment, the push button is a first push button, and the end cap accessory further includes a second push button operable to activate the light source to emit a solid or strobed light. In addition, the attachment section may include a threaded portion for removable attachment to the handle section of the baton. In particular, the battery compartment is dimensioned to hold at least two batteries in a side-by-side arrangement.

In another embodiment, the invention is an end cap accessory for use with a baton which includes an attachment section that removably attaches to an end of a handle section of a baton. In addition, the end cap accessory includes a tubular section extending from the attachment section, the tubular section having a first end that is inseparable from a second end that faces the attachment section, wherein between the first end and the second end, the tubular section comprises a battery compartment for holding a battery, and a light source operable to emit a solid or strobed light when powered by the battery, and a lens operable to focus the light emitted by the light source towards the opening. Still further, the end cap accessory includes a first push button and a second push button positioned on an exterior surface of the tubular section, wherein the first push button and the second push button are operable to activate the light source which may emit a solid or strobed light. In one embodiment, the first push button and the second push button are positioned on opposite sides of the tubular section. In some cases, at least one of the first push button and the second push button have a depressed position and a non-depressed position, wherein the light source is activated when the at least one of the first push button and the second push button is held in the depressed position by an external force. In addition, at least one of the first push button and the second push button are operable to have the ability to automatically transition to the non-depressed position in which the light source is inactivated upon removal of the external force. In some embodiments, a diameter of the tubular section is least 1.25 inches and a diameter of the attachment section is less than a diameter of the tubular section. Still further, the battery compartment may include at least two laterally spaced battery contacts and circuitry connected to the battery contacts to facilitate powering of the light source with the battery.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, a given figure may be used to illustrate the features of more than one embodiment of the invention in the interest of reducing the total number of drawings, and as a result, not all elements in the figure may be required for a given embodiment.

DETAILED DESCRIPTION

Several embodiments of the invention with reference to the appended drawings are now explained. Whenever aspects of the embodiments described here are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
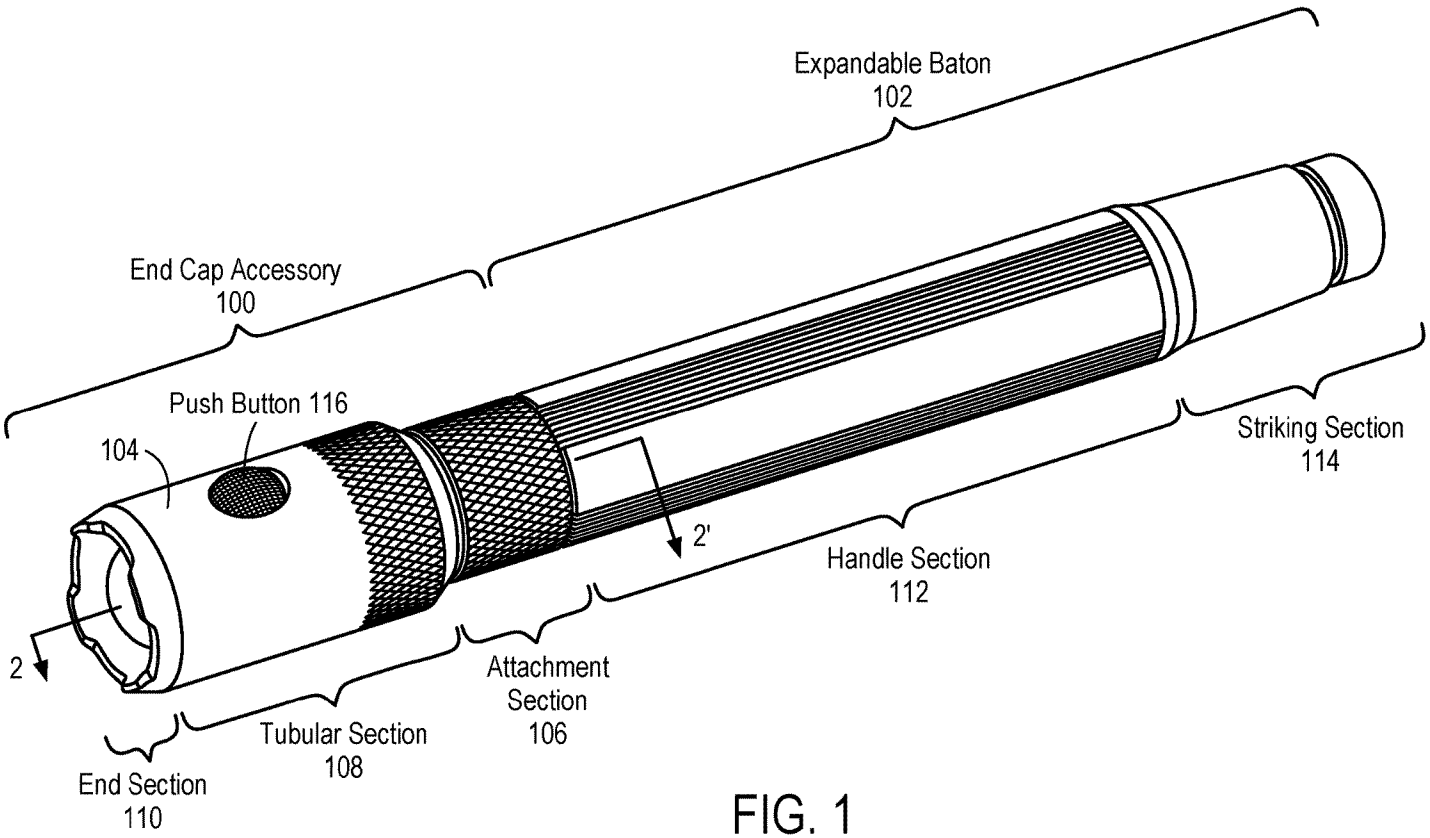
FIG. 1 illustrates a side perspective view of one embodiment of a diversionary end cap attached to a baton.

FIG. 1 illustrates a side perspective view of one embodiment of a diversionary end cap attached to a baton. Representatively, end cap 100 may be a diversionary device or accessory that can be attached to an impact weapon, such as a baton 102. End cap 100 may be designed to provide a less lethal weapon option for law enforcement personal to use against an assailant. In particular, end cap 100 may include a housing 104 within which a diversionary light source and batteries for powering the diversionary light source are housed. The term "diversionary light source" as used herein is intended to refer to a light source of a sufficient intensity to interfere with, or otherwise impair, a subject's vision to the extent that the subject is diverted or distracted from carrying out an action. The diversionary light source is different from that which would be used in a conventional flashlight in that it has a higher lumen output than that typically found suitable for use in a flashlight. For example, the light source may be a focused or collimated light capable of outputting solid or intermittent flashes of light of 750 lumens or more from the end cap 100. In other words, the light source may have a lumen rating of 750 or more. The light source may be any type of light source capable of outputting light at an intensity sufficient to divert a threat (i.e. 750 lumens or more). For example, in one representative embodiment, the light source is a light-emitting diode (LED).

The housing 104 may include an attachment section 106, a tubular section 108 and an end section 110. The attachment section 106 may extend from one end of the tubular section 108 and be used to attach the end cap 100 to the baton 102. For example, the attachment section 106 may be a cylindrical structure that includes threading along an inner surface. The threading may be complimentary to threading on an outer surface of baton 102 (which is also cylindrical), to facilitate attachment of the two pieces with one another. The tubular section 108 may be dimensioned to house the light source, one or more batteries for powering the light source and circuitry for operating the light source. In addition, one or more of a push button 116 for turning the light source on or off may be situated on the tubular section 108. The end section 110 may be formed at an end of tubular section 108 opposite attachment section 106. End section 110 may include an opening through which light from the light source can be output from tubular section 108. In some embodiments, end section 110 may include a bezeled edge such that the housing wall forming the end section 110 narrows in a direction of the inner surface of the housing wall of the end section 110. In still further embodiments, the end section 110 may be crenelated along the edge such that it includes open spaces, or recessed regions, along the edge. Each of the attachment section 106, tubular section 108 and end section 110 of housing 104 may be substantially cylindrical, although their diameters may be different as will be described in more detail in reference to FIG. 3. In addition, in one embodiment, each of the attachment section 106, tubular section 108 and end section 110 of housing 104 may be machined from an aircraft grade aluminum. Still further, one or more of attachment section 106, tubular section 108 and end section 110 of housing 104 may include an ergonomic anti-slip design and "knurled" elevations, as can be seen in more detail in reference to FIG. 2.

Baton 102 may be any type of baton, or other similar impact weapon (e.g. a night stick), which could benefit from a non-impact diversionary device such as end cap 100. For example, baton 102 may be a telescoping baton that includes a handle section 112 to which the end cap 100 may be attached and a telescoping striking section 114. The striking section 114 may include one or more tapered telescoping sections that telescope out from the handle to provide a striking tube that can be used against an assailant. In one embodiment, the handle section 112 has an outer diameter that is greater than 1 inch, for example about 1.125 inches to about 1.5 inches, or about 1.25 inches. The increased handle diameter further allows for a proportionately thicker and heavier striking section 114, as compared to a baton having a handle diameter of 1 inch or less. In addition, the increased handle diameter and heavier striking section 114 of baton 102 makes baton 102 suitable for attachment of an end cap 100 as disclosed herein without negatively impacting the effectiveness of baton 102. Representatively, in one embodiment, baton 102 may be an expandable baton such as that disclosed in U.S. Pat. No. 6,056,643, which is incorporated herein by reference.

Figure 2:
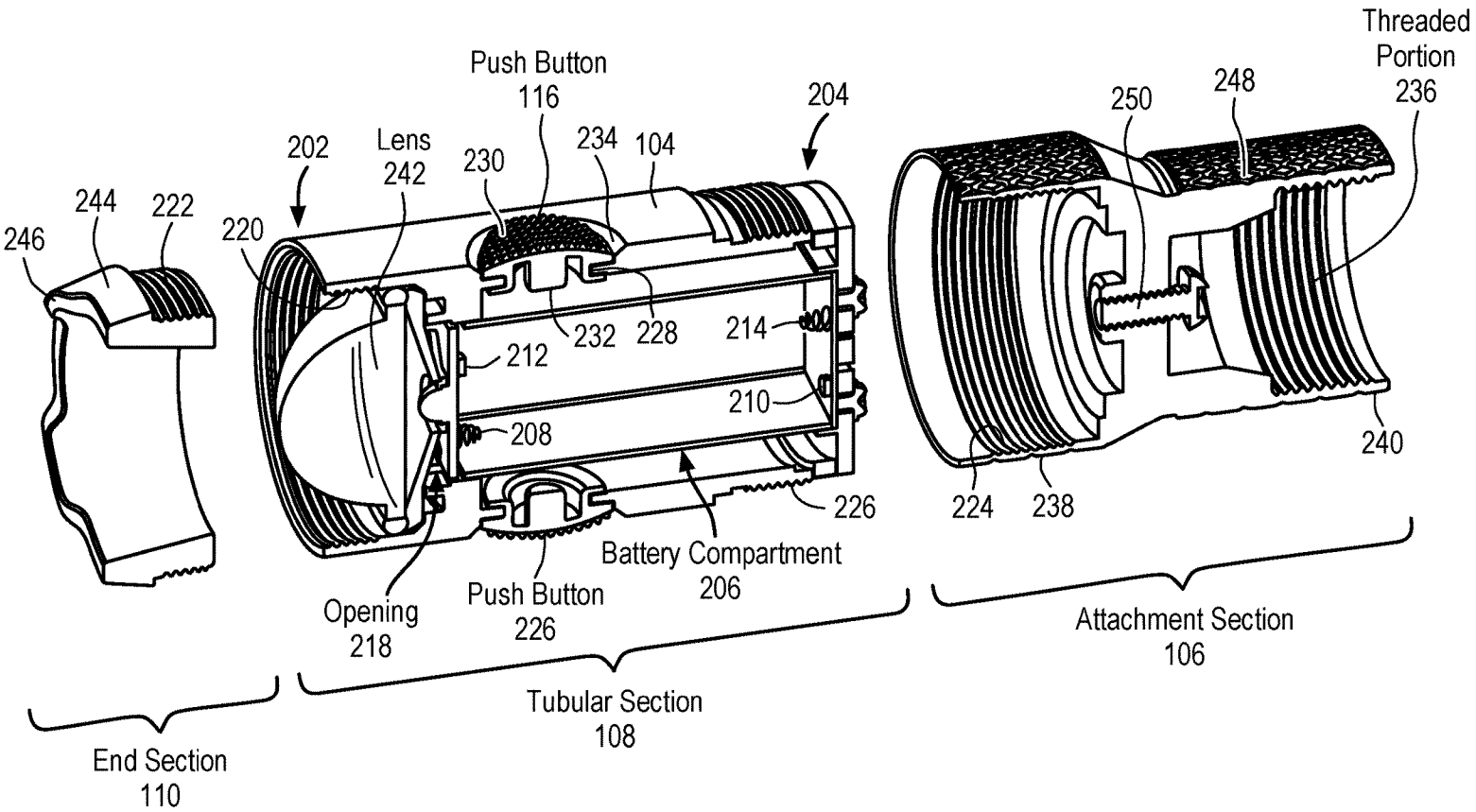
FIG. 2 illustrates an exploded perspective cross-sectional view of the end cap of FIG. 1 along line 2-2'.

FIG. 2 illustrates an exploded perspective cross-sectional view of the end cap of FIG. 1 along line 2-2'. From this view, aspects of the attachment section 106, tubular section 108 and end section 110 of housing 104 can be seen in more detail. In particular, from this view, it can be seen that tubular section 108 has a substantially tubular or cylindrical shape extending between a first end 202 and a second end 204. In one embodiment, the tubular section 108 may be one integrally formed, inseparable structure such that the first end 202 is inseparable from the second end 204. In one embodiment, an inner surface of first end 202 may include ridges or threading 220 that are complimentary to ridges or threading 222 on an outer surface of end section 110, to facilitate attachment of first end 202 to end section 110. In addition, the outer surface of second end 204 may include ridges or threading 226 that are complimentary to ridges or threading 224 on an inner surface of attachment section 106 to facilitate attachment of second end 204 to attachment section 106. Although complimentary attachment mechanisms are illustrated and described, it is contemplated that any suitable mechanism for attaching tubular section 108 to attachment section 106 and end section 110 may be used.

A battery compartment 206 is formed within tubular section 108, between the first end 202 and the second end 204. The battery compartment 206 may be a chamber that is machined, or otherwise formed within, a material of tubular section 108 of housing 104. In this aspect, the battery compartment 206 may be formed by an inner surface of the wall of housing 104 and is therefore integrally formed within tubular section 108 as one inseparable structure. The battery compartment 206 may be dimensioned to house at least two batteries since at least two duty rated batteries (e.g. two Panasonic® CR 123A batteries) are necessary to power a diversionary light source as disclosed herein (e.g. a light source with at least a 750 lumen rating). It is important, however, that an overall length of end cap 100 not be increased in order to accommodate two batteries as this would compromise the utility of the baton to which end cap 100 is attached. In particular, adding a significant amount of additional length to a baton handle may cause it to undesirably extend out the top of a holster carried by a law enforcement officer. In addition, significantly extending the baton length can also change the balance of the baton, which will in turn, affect the kinetic energy transfer, and ultimately effectiveness, of the baton.

Therefore, in order to maintain a minimum overall length of end cap 100, battery compartment 206 is dimensioned to accommodate at least two batteries in a side-by-side arrangement. This is in contrast to an end-to-end battery arrangement, which would ultimately increase an overall length of the end cap beyond that which is suitable for attachment to a baton for the reasons previously discussed. In addition, battery compartment 206 includes battery contacts 208, 210, 212 and 214 to provide an electrical connection between the terminals of the batteries positioned therein and circuitry for operating light source 216.

Light source 216 is also positioned within tubular section 108. Light source 216 may be mounted within an opening 218 formed within first end 202 of tubular section 108. As previously discussed, the light source 216 is a diversionary light source in that it is of a sufficient intensity to interfere with, or otherwise impair, a subject's vision to the extent that the subject is diverted or distracted from carrying out an undesirable action. The diversionary light source may therefore have a higher lumen output than that typically found suitable for use in a stand alone flashlight. For example, the light source may be a light capable of outputting light of 750 lumens or more from the end cap 100. In other words, the light source may have a lumen rating of 750 or more. The light source 216 may be operable in a continuous or solid mode (i.e. continuously "on") or an intermittent or strobe mode (i.e. transitioning between "on" and "off"). In one embodiment, an overall run time of the light source 216 may be 90 hours at 750+ to 20 lumens (when in the continuous "on" mode). In other embodiments in which the light source 216 is in the intermittent mode, the run time may be 90 hours at 750+ lumens. In addition, when light source 216 is in the intermittent or strobe mode, a frequency or period of the intermittent flashes of light may be controlled and varied by the user. Representatively, the intermittent flashes may vary between a high frequency mode and a low frequency mode. For example, the intermittent flashes may vary between about 10 flashes per second (low frequency mode) to hundreds of flashes per second (high frequency mode) depending upon the threat to be diverted. The light source may be any type of light source capable of outputting light at an intensity sufficient to divert a threat (i.e. 750 lumens or more). For example, in one representative embodiment, the light source is a light-emitting diode (LED).

One or more of buttons 116, 226 for operating light source 216 may further be included within tubular section 108. Each of buttons 116, 226 may extend through a button opening 228 within the wall forming tubular section 108. Each of buttons 116, 226 may have an external side 230 and an internal side 232. The external side 228 rests along the outer surface of tubular section 108 and provides a contact surface for the user. The internal side 232 rests along the inner surface of tubular section 108 and provides a contact surface for actuating the light source 216. In one embodiment, button 116 is positioned along one side of tubular section 108 and button 226 is positioned along an opposite side. In other words, the position of button 116 along the tubular section 108 is diametrically opposed to button 226, or otherwise considered bilaterally positioned.

One or more of buttons 116, 226 may be push buttons that only turn "on" light source 216 when an external force is applied. In the absence of the external force, light source 216 transitions back to an "off" mode. In this aspect, one or more of buttons 116, 226 may be considered a "dead man switch." It is contemplated, however, that in other embodiments, a force may need to be applied to one or more of buttons 116, 226 to turn light source 216 both "on" and "off." For example, button 116 may be pressed to turn light source 216 to the "on" mode (e.g., light emitting mode), and button 226 may be pressed to turn light source 216 to the "off" mode (e.g., no light emitted). In addition, in some embodiments, the external side 230 of one or more of buttons 116, 226 may be textured so that the user can locate buttons 116, 226 through touch. In addition, the textured external side 230 may help to prevent the user's finger from sliding off of buttons 116, 226 during operation. In some cases, the surface area 234 surrounding the textured external side 230 may be smooth and beveled along the edge of the wall forming the button opening 228 to further help the user identify the location of buttons 116, 226. It should further be understood that although two buttons 116, 226 are disclosed, it is contemplated that only one of buttons 116, 226 is necessary to operate light source 216.

In addition to battery compartment 206, light source 216 and buttons 116, 226, circuitry for providing power from the batteries within the battery compartment 206 to the light source 216 may further be provided within tubular section 108. The circuitry will be described in more detail in reference to FIG. 3.

As previously discussed, attachment section 106 may be attached to the second end 204 of tubular section 108. Attachment section 106 is dimensioned to attach end cap 100 to a handle of a baton (e.g. baton 102). In this aspect, attachment section 106 may include a first attachment end 238 and a second attachment end 240. The first attachment end 238 may include the threading or ridges 224 used to attach the attachment section 106 to the tubular section 108 as previously discussed. The second attachment end 240 may include a threaded portion 236, which includes threading along its inner surface for attaching the attachment section 106 to a baton.

The first attachment end 238 and the second attachment end 240 may both have a cylindrical shape, however, the first attachment end 238 and the second attachment end 240 may have different diameters. For example, a diameter of first attachment end 238 may be similar to that of tubular section 108 to allow for attachment to tubular section 108 and the diameter of second attachment end 240 may be similar to that of the baton to allow for attachment to the baton. Representatively, in one embodiment, a diameter of first attachment end 238 may be greater than a diameter of second attachment end 240. Moreover, in some embodiments, in addition to the threading or ridges 224 for attaching the attachment section 106 to tubular section 108, a bolt 250 (or other similar attachment mechanism) may be used to secure the attachment section 106 to tubular section 108 as illustrated in FIG. 2.

In still further embodiments, an outer surface of attachment section 106 includes knurled elevations 248 to facilitate gripping by the user. The knurled elevations 248 may consist of a pattern of straight, angled or crossed lines cut into the surface of attachment section 106. The knurled elevations 248 may be formed along one or both ends of attachment section as desired.

End cap 100 further includes end section 110 attached to the first end 202 of tubular section 108. End section 110 may be a ring like structure used to secure a lens 242 over light source 216. Representatively, as previously discussed, end section 110 may include threading or ridges 222 along its outer surface that are complimentary to threading or ridges 220 along the inner surface of tubular section 108. Once lens 242 is positioned over light source 216 as shown in FIG. 2, end section 110 is secured over lens 242, and to tubular section 108 using ridges 222, to hold lens 242 in place. End section 110 may have a bezel 244 at the end opposite tubular section 108. In addition, the bezeled edge may include crenelations 246.

The lens 242 may be a specially collimated acrylic or polycarbonate lens suitable for narrowing or focusing the light from light source 216. Representatively, in one embodiment, lens 242 narrows 30 percent to 40 percent of the light from light source 216. In one embodiment, lens 242 is a convex lens with a sufficient steepness to focus the light from the light source 216 by about 30 percent to about 40 percent.

Figure 3:
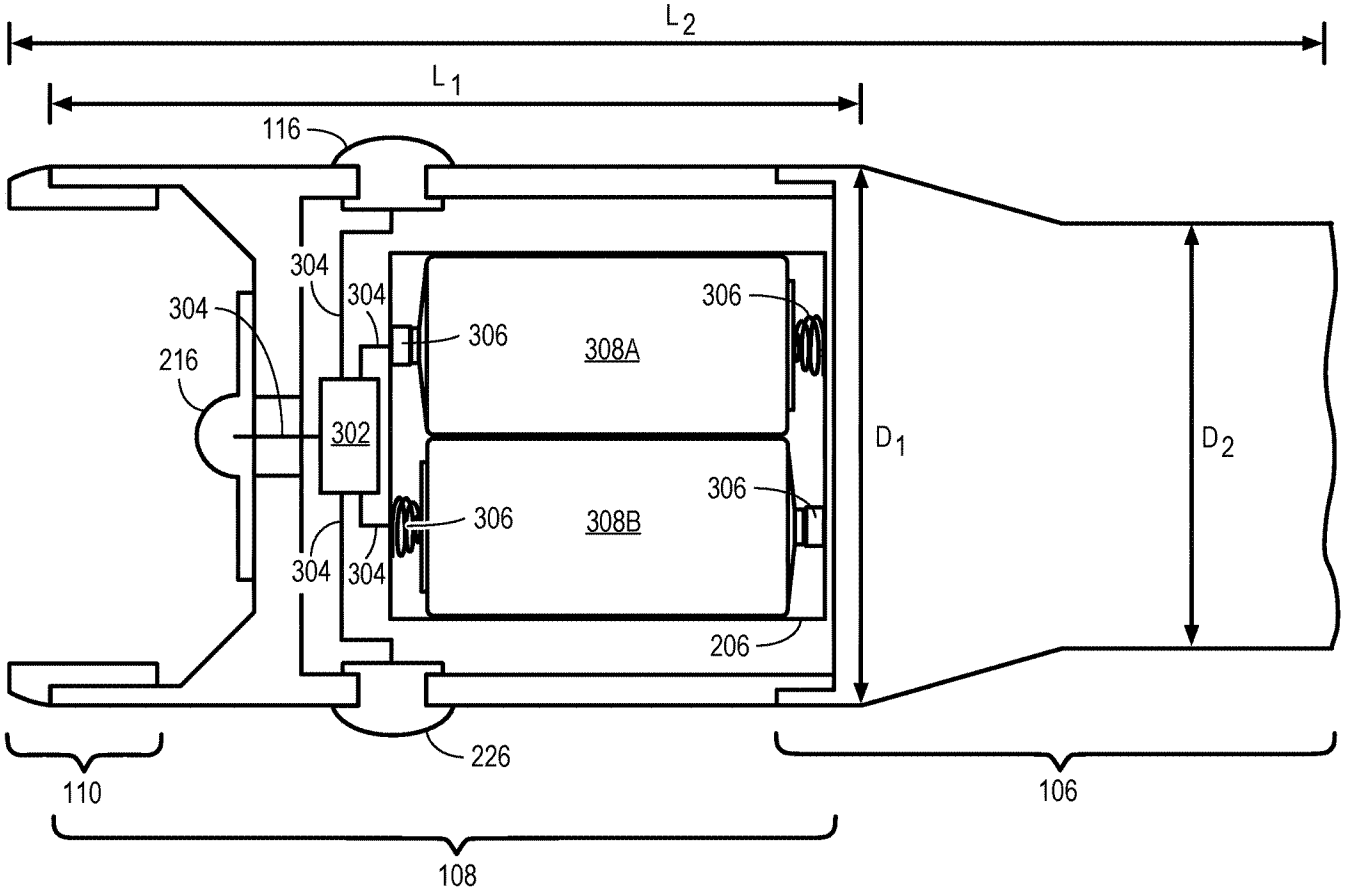
FIG. 3 illustrates a schematic cross-sectional view of the end cap of FIG. 1 along line 2-2.'

FIG. 3 illustrates a schematic cross-sectional view of the end cap of FIG. 1 along line 2-2'. From this view, the dimensions of end cap 100 as well as the circuitry used to operate the light source within end cap 100 can be seen in more detail. In particular, from this view, it can be seen that tubular section 108 includes battery compartment 206 dimensioned to contain two batteries 308A, 308B in a side-by-side arrangement. As previously discussed, the arrangement of batteries 308A, 308B side-by-side, as opposed to end-to-end, allows end cap 100 to maintain a relatively short overall length. In particular, the battery compartment 206 within tubular section 108 need only be long enough to accommodate one length of a battery instead of two battery lengths, therefore the overall length (L1) of tubular section 108 can be much smaller than if the batteries were end-to-end. For example, tubular section 108 may have a length (L1) of from about 1.5 inches to about 3 inches, or from about 2 inches to about 2.5 inches, or more preferably about 2.2 inches.

Moreover, the reduced length (L1) of tubular section 108 allows for end cap 100 to also have a reduced overall length (L2). For example, end cap 100 may have a length (L2) of from about 3 inches to about 4 inches, for example, from about 3.2 inches to about 3.8 inches, or about 3.7 inches.

In addition, tubular section 108 may have a diameter (D1) sufficient to accommodate the side-by-side battery arrangement within battery compartment 206. For example, in one embodiment, tubular section 108 may have a diameter of greater than 1 inch, for example, from about 1.25 inches to about 2 inches, more preferably about 1.5 inches. As previously discussed, however, attachment section 106 may have a different diameter than tubular section 108 to accommodate attachment to a baton handle. For example, attachment section 106 may have a diameter (D2) that is greater than 1 inch but less than that of D1. Representatively, diameter (D2) may be from about 1.125 inches to about 1.5, or more preferably, about 1.25 inches. It should further be understood that an overall weight of end cap 100 may be from about 6.5 ounces to about 8 ounces, or from about 7.1 ounces to about 7.4 ounces, for example, about 7.26 ounces.

In addition, battery compartment 206 includes side-by-side battery contacts 306 for contacting the terminals of each of batteries 308A, 308B and providing power to light source 216. In other words, two of contacts 306 at one end of the battery compartment 206 are laterally spaced from one another and the other two contacts 306 are laterally spaced at the other end of battery compartment 206. The battery contacts 306 are in turn electrically connected to a controller or processor 302 within tubular section 108 by circuitry 304 (e.g. wires). The controller or processor 302 may, for example, be powered by one or more of batteries 308A, 308B and implemented based on microprocessors, application-specific integrated circuits (ASICs), field-programmable gate arrays (FPGAs), a set of hardware logic structures (e.g., filters, arithmetic logic units, and dedicated state machines), or other types of circuitry. In some embodiments, the batteries 308A, 308B may also be used to power the light source 216 in addition to the processor 302 and other elements of end cap 100.

Processor 302 may further be electrically connected to buttons 116, 226 and light source 216 using circuitry 304 as shown. Representatively, in one embodiment, circuitry 304 may include CREE XM-L LED digital circuit technology for maximum durability and battery life. Processor 302 may be programmed to operate the light source 216 according to various diversionary lighting modes. Representatively, the light source 216 may have an "on" mode and an "off" mode, as well as a continuous mode in which the light output in the "on" mode is constant, and an intermittent or strobe mode, in which the light output in the "on" mode is intermittent. In addition, when in the intermittent or strobe mode, the processor 302 may further control the frequency or period of the intermittent light flashes based on user input. For example, in one embodiment, the intermittent mode may have a high frequency mode and a low frequency mode, with the light flashes being more frequent in the high frequency mode and less frequent in the low frequency mode. The various modes may be determined based on user input. For example, when the user applies an initial force to one or both of buttons 116, 226, circuitry 304 transmit this information to the processor 302, and the processor 302 causes the light source 216 to transition to the "on" mode. When the force on one or both of buttons 116, 226 remains constant, the processor 302 causes the light source 216 to enter the intermittent or strobe mode. The frequency of the light flashes in the strobe mode can be selected by applying an additional force to one or both of buttons 116, 226 (e.g. pressing harder). When the user removes the force from one or both of buttons 116, 226, the processor 302 causes the light source 216 to automatically transition to the "off" mode. It should, however, be understood that the above-description provides only one exemplary way of controlling and/or operating the light source. Other suitable mechanisms for controlling and/or operating light source 216 may be used. In addition, processor 302 may be equipped with a battery saving mode in which the light output from light source 216 may be reduced in order to conserve the life of batteries 308A, 308B.

In this aspect, during operation, upon the first sign of an assailant, an officer may withdraw a baton including end cap 100 from his or her holster. One or both of buttons 116, 226 are then depressed so that the light source 216 emits the diversionary light beam into the eyes of the assailant. In particular, one or both of buttons 116, 226 have a depressed position and a non-depressed position. The light source 216 is activated (or "on") when one or both of buttons 116, 226 are held in the depressed position (e.g. pressed by the user). The buttons 116, 226 automatically transition to the non-depressed position in which the light source is inactivated (or "off") upon removal of the external force applied by the user. It is contemplated that due to the intensity of the light, it need only be directed into the assailant's eyes for 1 to 2 seconds in order to create a sufficient diversion. For example, the light source 216 may be used to create a diversionary window of opportunity for the officer (or a group of officers) to utilize other tactical options, including immediate use of the associated baton. In other embodiments, however, the light source 216 may remain activated when the user removes the external force from one or more of buttons 116, 226, and an additional external force must be applied to one or more of buttons 116, 226 to inactivate light source 216.

While certain embodiments have been described and shown in the accompanying drawings, it is to be understood that such embodiments are merely illustrative of and not restrictive on the broad invention. For example, although the diversionary end cap disclosed herein is described for use in combination with impact weapons used by law enforcement personnel, the diversionary end cap may be used alone or in combination with any other device where a diversionary light source may be desired. For, example, the end cap may be used by a camper, hiker cyclist, driver, or the like, to divert or distract an oncoming animal. For example, the end cap could include a clip and be attached directly to a person or a person's garment or backpack. Still further, the end cap could be attached to a bicycle, motorcycle, automobile, camper or the like to divert an animal away from a moving vehicle. Thus, the invention is not limited to the specific constructions and arrangements shown and described herein and various other modifications may occur to those of ordinary skill in the art.

What is claimed is:

1. An end cap accessory for use with a baton, the end cap accessory comprising:

an attachment section that removably attaches to an end of a handle section of a baton;

a tubular section with an opening that faces away from the attachment section, wherein the tubular section includes therein a battery compartment for holding a battery, a light source operable to emit a light when powered by the battery, and a lens operable to focus the light emitted by the light source towards the opening;

a push button positioned on an exterior surface of the tubular section, wherein the push button is operable to activate the light source to emit the light when held in a depressed position; and an end section attached to the tubular section, the end section is positioned around the opening of the tubular section, and wherein the attachment section, the tubular section and the end section are exterior to the handle section of the baton when the attachment section is removably attached to the end of the handle section of the baton.

2. The end cap accessory of claim 1, wherein the light source emits at least 750 lumens of light when powered by the battery.

3. The end cap accessory of claim 1, wherein the light source comprises a light-emitting diode (LED).

4. The end cap accessory of claim 1, wherein the light source is a strobe light and the light is emitted as intermittent flashes of light.

5. The end cap accessory of claim 1, wherein the lens is a collimated polycarbonate lens or a collimated acrylic lens.

6. The end cap accessory of claim 1, wherein the exterior surface of the tubular section is knurled.

7. The end cap accessory of claim 1, wherein the push button has a textured surface and a surface surrounding the push button is smooth.

8. The end cap accessory of claim 1, wherein the attachment section and the tubular section are formed of aluminum material.

9. The end cap accessory of claim 1, wherein the push button is a first push button, the end cap accessory further comprising a second push button operable to activate the light source to emit a light.

10. The end cap accessory of claim 1, wherein the attachment section includes a threaded portion for removable attachment to the handle section of the baton.

11. The end cap accessory of claim 1, wherein the battery compartment is dimensioned to hold at least two batteries in a side-by-side arrangement.

12. An end cap accessory for use with a baton, the end cap accessory comprising:

an attachment section that removably attaches to an end of a handle section of a baton;

a tubular section extending from the attachment section, the tubular section having a first end that is inseparable from a second end that faces the attachment section, wherein between the first end and the second end, the tubular section comprises a battery compartment for holding a battery, and a light source operable to emit a light when powered by the battery, and a lens operable to focus the light emitted by the light source towards the opening; and a first push button and a second push button positioned on an exterior surface of the tubular section, wherein the first push button and the second push button are operable to activate the light source to emit light, and wherein the attachment section and the tubular section are exterior to the handle section of the baton when the attachment section is removably attached to the end of the handle section of the baton.

13. The end cap accessory of claim 12 further comprising:

an end section attached to the first end of the tubular section, the end section having a crenelated bezel edge.

14. The end cap accessory of claim 12 wherein the attachment section includes a threaded interior surface for removable attachment to the handle section of the baton.

15. The end cap accessory of claim 12 wherein the first push button and the second push button are positioned on opposite sides of the tubular section.

16. The end cap accessory of claim 12 wherein at least one of the first push button and the second push button have a depressed position and a non-depressed position, wherein the light source is activated when the at least one of the first push button and the second push button is held in the depressed position by an external force.

17. The end cap accessory of claim 16 wherein the at least one of the first push button and the second push button are operable to automatically transition to the non-depressed position in which the light source is inactivated upon removal of the external force.

18. The end cap accessory of claim 12 wherein a diameter of the tubular section is least 1.25 inches, and a diameter of the attachment section is less than a diameter of the tubular section.

19. The end cap accessory of claim 12 wherein the light source emits regular flashes of the light.

20. The end cap accessory of claim 12 wherein the battery compartment comprises at least two laterally spaced battery contacts and circuitry connected to the battery contacts to facilitate powering of the light source with the battery.

21. An end cap accessory for use with a baton, the end cap accessory comprising:

an attachment section having a threaded interior surface that removably attaches to an end of a handle section of a baton;

a tubular section extending from the attachment section, the tubular section having a first end that is inseparable from a second end that faces the attachment section, wherein between the first end and the second end, the tubular section comprises a battery compartment for holding a battery, and a light source operable to emit a light when powered by the battery, and a lens operable to focus the light emitted by the light source towards the opening; and a first push button and a second push button positioned on an exterior surface of the tubular section, wherein the first push button and the second push button are operable to activate the light source to emit light.

* * * * *